United States Patent [19]

Yamanashi et al.

[11] Patent Number: 5,057,042

[45] Date of Patent: Oct. 15, 1991

[54] ELECTRICAL CONNECTOR INCLUDING TERMINAL CONNECTOR WITH STABILIZER

[75] Inventors: Makoto Yamanashi; Isao Kameyama, both of Shizuoka, Japan

[73] Assignee: Yazaki Corporation, Tokyo, Japan

[21] Appl. No.: 651,863

[22] Filed: Feb. 7, 1991

[30] Foreign Application Priority Data

Feb. 21, 1990 [JP] Japan ..... 2-15630[U]

[51] Int. Cl.[5] ..... H01R 13/426

[52] U.S. Cl. ..... 439/752; 439/595

[58] Field of Search ..... 439/594, 595, 752

[56] References Cited

U.S. PATENT DOCUMENTS 4,969,841 11/1990 Sueyoshi et al. ..... 439/594 X 4,975,082 12/1990 Nagasaka et al. ..... 439/595

4,998,896 3/1991 Lundergan ..... 439/595

*Primary Examiner*—Eugene F. Desmond

*Attorney, Agent, or Firm*—Sughrue, Mion, Zinn, Macpeak & Seas

[57] ABSTRACT

In an electrical connector, a metal terminal is provided with a stabilizer piece which hangs from a bottom of the terminal to facilitate straight-line insertion of the terminal into a terminal retainer in a connector housing. The terminal retainer has a smooth surface from which a passage guide projection extends, forming a guide for movement of the stabilizer piece. The height of the projection is greater than the depth of the stabilizer piece, so that the metal terminal slides smoothly into the terminal retainer, while the stabilizer piece still is able to prevent rotation of the terminal during insertion.

2 Claims, 2 Drawing Sheets

ELECTRICAL CONNECTOR INCLUDING TERMINAL CONNECTOR WITH STABILIZER

BACKGROUND OF THE INVENTION

This invention relates to a terminal retainer for an electrical connector used to interconnect wire harnesses or the like.

In FIG. 5, a first flexible retaining piece e for a metal terminal c is provided within a terminal receiving chamber d of a connector housing a. A second flexible retaining piece f for the metal terminal c is provided on a terminal retainer b.

In a provisional retaining condition as shown in FIG. 5, the terminal retainer b is connected beforehand to the connector housing a. In this condition, the metal terminal c is inserted into the terminal receiving chamber d through an insertion hole b2 of a main frame portion b1 of the terminal retainer b, so that a retaining projection e1 of the terminal retaining piece e is engaged in a retaining hole c1. Subsequently, the terminal retainer b is pushed so as to shift the retaining piece e1 to a complete retaining condition. As a result, a retaining end f1 of the flexible retaining piece f is engaged with a shoulder c2, thus preventing rearward withdrawal of the metal terminal c in two ways.

A stabilizer c3 for controlling the position of the terminal c during insertion thereof is formed so as to project from the lower side of the metal terminal c. At the time of insertion of the metal terminal c, the stabilizer c3 can become caught by the main frame portion b1, thus degrading the efficiency of the insertion operation.

SUMMARY OF THE INVENTION

With the above problem in view, it is an object of this invention to provide a construction in which a metal terminal having a projecting piece such as the above-mentioned stabilizer can be passed easily through an insertion hole of a main frame portion of an electrical connector.

The above object has been achieved by a terminal retainer for a connector in which the terminal retainer is adapted to be connected to a connector housing at two stages, one of which is a provisional retaining condition, and the other of which is a complete retaining condition. A passage guide projection having a smooth guide surface for engagement with a bottom portion of a metal terminal is formed on a surface of an insertion hole formed in a main frame portion of the terminal retainer, the main frame portion having a retaining piece for the metal terminal. In the disclosed embodiment, the passage guide injection extends upwardly from the insertion hole surface. The amount of projection of the passage guide projection is greater than the amount of projection of a stabilizer depending from the bottom portion of the metal terminal. As a result, the stabilizer is able to slide smoothly during insertion of the metal terminal into the terminal retainer.

DETAILED DESCRIPTION OF THE PREFERRED EMBODIMENT

Figure 1:
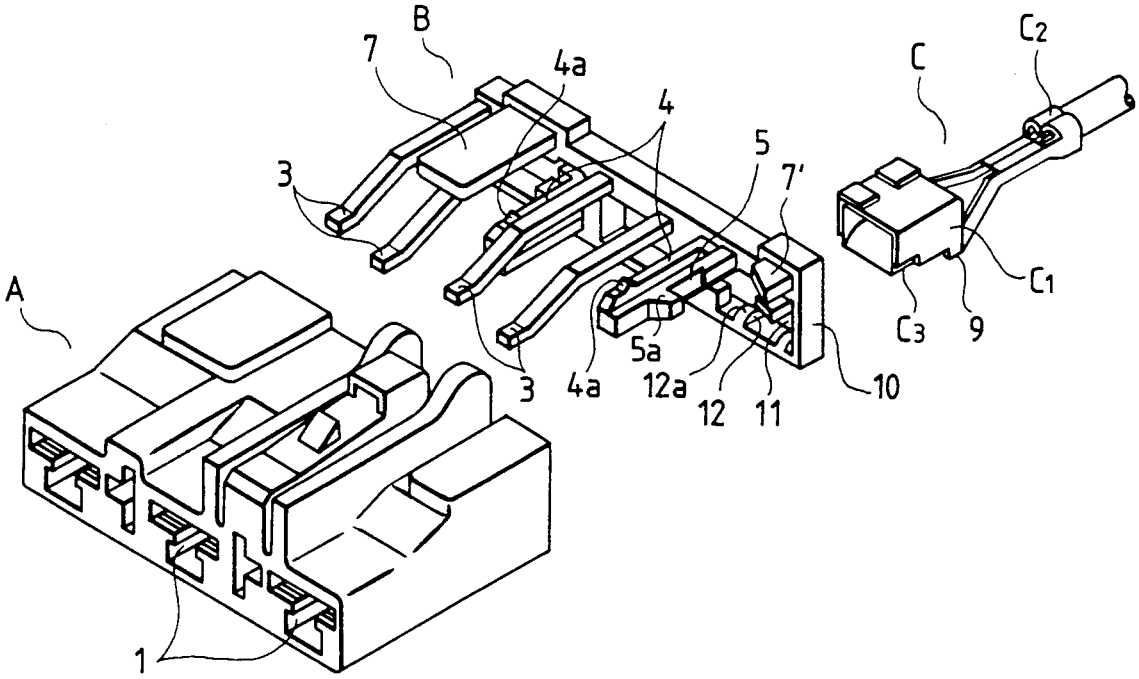
FIG. 1 is a partly-broken, perspective view of one preferred embodiment of the present invention.
Figure 2:
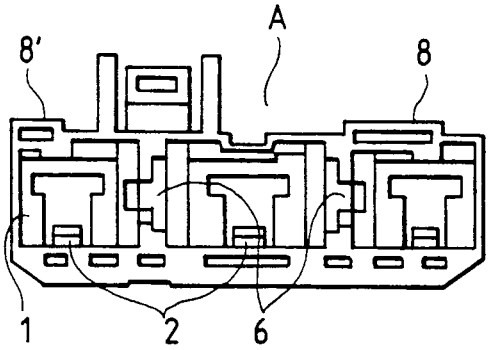
FIG. 2 is a rear view of a connector housing.
Figure 3:
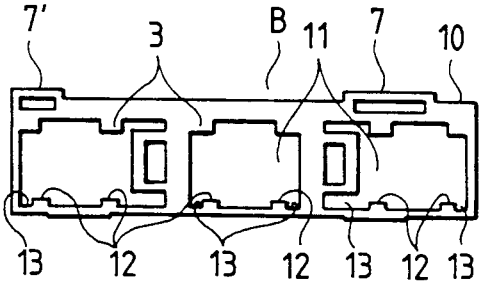
FIG. 3 is a rear view of a terminal retainer.

In FIGS. 1 to 4, a first flexible retaining piece 2 for a metal terminal C is provided within each terminal receiving chamber 1 of a connector housing A. A plurality of pairs of second flexible retaining pieces 3 are provided on a terminal retainer B. Each pair of second flexible retaining pieces 3 serve to retain a respective one of the metal terminals C.

The terminal retainer B includes provisional retaining pieces 4 each having a provisional retaining projection 4*a*, and complete retaining pieces 5 each having a complete retaining projection 5*a*. Each retaining frame 6 of the connector housing has a retaining portion with which the projection 4*a* and the projection 5*a* are engageable. Insertion position-limiting plates 7 and 7' are formed on the terminal retainer B, and are extended forwardly. Insertion guide holes 8 and 8' for receiving respective insertion position-limiting plates 7 and 7' are open to the rear surface of the connector housing A.

The metal terminal C includes an electric contact portion Cl and an electric wire connection portion C2. A pair of stabilizers 9 for controlling the position of the metal terminal C as it is inserted into the terminal receiving chamber 1 are formed on and project downwardly from a bottom portion C3 of the electric contact portion C1. A pair of passage guide projections 12 for guiding the bottom portion C3 are provided on a surface of each insertion hole 11 of a main frame portion 10 of the terminal retainer B, each of the passage guide projections 12 having a smooth guide surface 12*a* or the like having an arcuate shape. A passage allowing groove 13 for passing the stabilizer 9 is formed at the side of each passage guide projection 12. In this case, the amount of projection of the passage guide projection 12 is greater than the amount of projection of the stabilizer 9.

Figure 4:
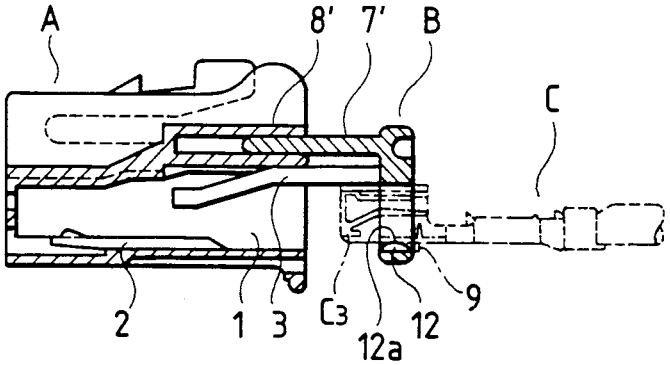
FIG. 4 is a partly-broken, side-elevational view showing the condition of use of the terminal retainer.
Figure 5:
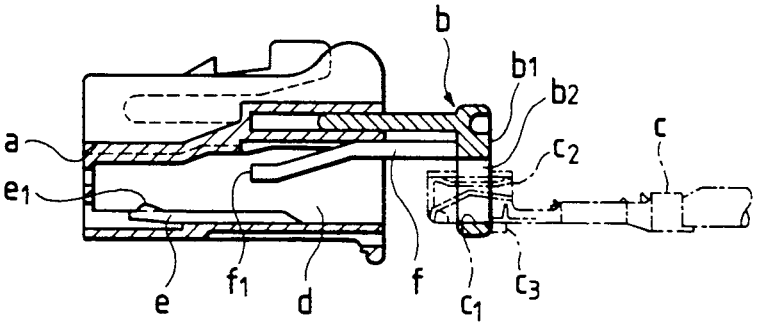
FIG. 5 is a partly-broken, side elevational view of a conventional connector showing a condition of use thereof.

In the above construction, FIG. 4 shows a provisional retaining condition in which the insertion position-limiting plates 7 and 7' are engaged in respective insertion guide holes 8 and 8', and each provisional retaining projection 4*a* is engaged in the corresponding retaining portion of the retaining frame 6. In this condition, when the metal terminal C is to be moved into the terminal receiving chamber 1 through the insertion hole 11 of the main frame portion 10 of the terminal retainer B, the bottom portion C3 impinges on the passage guide projections 12, and slides easily over them through the smooth guide surfaces 12*a*. At the same time, the stabilizers 9 pass through respective passage allowing grooves 13. Thus, the metal terminal C can be moved easily into and out of the terminal receiving chamber 1.

As described above, according to the present invention, the terminal retainer is adapted to be connected to the connector housing at two stages, one of which is the provisional retaining condition, and the other of which is the complete retaining condition. The passage guide projections each have a smooth guide surface for engagement with the bottom portion of the metal terminal, and are formed on the surface of an insertion hole formed in the main frame portion of the terminal retainer having the retaining piece for the metal terminal. The amount of projection of the passage guide projection is greater than the amount of projection of the stabilizer depending from the bottom portion of the metal terminal. Therefore, attachment and detachment of the metal terminal with the stabilizer can be carried out efficiently.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. In an electrical connector comprising at least one metal terminal and a terminal retainer having at least one insertion hole for receiving said at least one metal terminal, the improvement wherein said electrical connector further includes a connector housing, and wherein:

said at least one metal terminal comprises a stabilizer formed so as to project from a bottom of said at least one metal terminal; and said insertion hole of said at least one terminal retainer has formed therein a passage guide projection having a smooth guide surface for engagement with a bottom portion of said at least one metal terminal;

such that said at least one terminal retainer is adapted to be connected to said connector housing at two stages, one of which is a provisional retaining condition, and the other of which is a complete retaining condition;

wherein an amount of projection of said passage guide projection is greater than an amount of projection of said stabilizer, such that said at least one metal terminal slides smoothly in said insertion hole, while having its insertion stabilized by said stabilizer.

2. An electrical connector as claimed in claim 1, wherein said at least one metal terminal comprises a plurality of metal terminals, and said at least one terminal retainer comprises a plurality of insertion holes for said metal terminals, said connector housing receiving said terminal retainer.

* * * * *